US005428557A

United States Patent [19]

Harbaugh et al.

[11] Patent Number: 5,428,557

[45] Date of Patent: Jun. 27, 1995

[54] SHEET MATERIAL COIL COUNTER

[75] Inventors: Mark M. Harbaugh, Shaker Heights; Lawrence M. Sears, Hunting Valley, both of Ohio

[73] Assignee: Arco Heating & Air Conditioning Co., Bedford Hts., Ohio

[21] Appl. No.: 243,805

[22] Filed: May 17, 1994

Related U.S. Application Data

[63] Continuation of Ser. No. 67,746, May 26, 1993, abandoned.

[51] Int. Cl.[6] ..... G06M 7/10

[52] U.S. Cl. ..... 364/562; 364/563; 377/8; 377/28

[58] Field of Search ..... 364/560–563, 364/468–470; 310/12; 377/3, 8, 12, 19, 28, 53; 356/429, 445, 242; 340/675

[56] References Cited

U.S. PATENT DOCUMENTS

| | | | |
|---|---|---|---|
| 3,835,306 | 9/1974 | Bills et al. | 235/925 B |
| 4,232,218 | 11/1980 | Kenton et al. | 250/222 PC |
| 4,323,768 | 4/1982 | Uchida | 271/95 |
| 4,475,163 | 10/1984 | Chandler et al. | 364/562 |
| 5,005,192 | 4/1991 | Duss | 377/8 |

*Primary Examiner*—Emanuel T. Voeltz
*Assistant Examiner*—Craig Steven Miller

[57] ABSTRACT

A method apparatus for determining the length of a roll of sheet material, including a side surface at which the edge of each of the plurality of layers of sheet material is exposed wherein the side surface of the roll of sheet material is exposed to a source of radiation and the radiation reflected from the edges of the roll is scanned in a radial direction to establish a first signal indicative of the reflected radiation and the number of edges of layers of sheet material. The length of the roll of sheet material is calculated using the sensed number of layers of sheet material in the roll. The method and apparatus are similarly adapted to determine the number of layers of sheet material in a stack of sheet material.

43 Claims, 3 Drawing Sheets

SHEET MATERIAL COIL COUNTER

This application is a continuation of application Ser. No. 08/067,746 entitled Sheet Material Coil Reader filed May 26, 1993now abandoned.

DESCRIPTION—TECHNICAL FIELD

The present invention relates to a method and apparatus for calculating the length of a roll of coiled sheet material including a side surface at which the edge of each of the plurality of layers is exposed by sensing radiation reflected from the edges of the plurality of layers in the coiled roll of sheet material to be measured.

BACKGROUND OF THE INVENTION

Sheet material, such as sheet steel which is sold in a coiled roll, is sold by the pound. The length of the roll of material is calculated using the density of the steel, roll weight and gauge. Variations in the nominal gauge of the steel lead to unacceptable errors in length calculations. It has been found, for example, that 0.26 gauge galvanized sheet steel varies in thickness between 0.0187 and 0.0247, and 30 gauge galvanized sheet steel varies between 0.0127 and 0.0187. These variations in thickness provide unacceptable errors in the present way in which the length is calculated. For example, due to non-uniformity in the thickness of the steel, a 5 on roll of 48" width 28 gauge galvanized steel can vary in length between 3,808 feet and 4,864 feet. Thus, there can be a considerable difference in the length of two like gauge and like weight rolls of steel. Coiled rolls of sheet metal are bought by the pound and then the sheet metal is used by the square foot to manufacture various products. Difference in the length of the rolls is critical in the use of the sheet metal in calculating the cost of items manufactured from the sheet material.

SUMMARY OF THE INVENTION

Accordingly, it is a provision of the present invention to provide a new and improved method and apparatus for accurately determining the length of a roll of sheet material in which a scanner scans in a radial direction radiation reflected from the edges of the roll to be measured and establishes a first signal indicative of the radiation reflected and wherein a microprocessor processes the first signal to determine the number of edges of sheet material in the roll to be measured, and calculates the length of the roll of material to be measured using the diameter of the roll and the sensed number of layers of sheet material in the roll. The use of the determined number of edges of sheet material is indicative of the number of layers or wraps in the coil of sheet material and compensates for errors in the length calculations due to variances in the thickness of the sheet material both between rolls and within a single roll.

Another provision of the present invention is to provide a new and improved apparatus for determining the length of a roll of a plurality of layers of sheet material, having a side surface in which the edge of each of the plurality of layers is exposed, including a source of radiation directed to the side surface of the roll, scanner means for scanning in a radial direction the radiation reflected from the side surface of the roll to establish a first signal, a microprocessor for processing the first signal to determine the presence of an exposed edge of each of the plurality of layers of sheet material in the roll, and wherein the microprocessor determines the number of edges of layers of sheet material in the roll and calculates the length of the roll of material using the diameter of the roll and the sensed number of layers of sheet material in the roll.

A still further provision of the present invention is to provide an apparatus for determining the length of a roll of sheet material as set forth in the preceding paragraph, further including encoder means for establishing a second signal indicative of the position of the scanner as the scanner scans the edge of the roll to be measured.

Still another provision of the present invention is to provide a method of determining the length of a roll of a plurality of layers of sheet material, including the steps of exposing the side surface of the roll to be measured to a source of radiation, sensing the radiation reflected from the side surface of the roll, establishing a first signal indicative of the sensed reflected radiation, processing the first signal to determine the presence of an edge of each of the layers of sheet material in the roll to be measured and the number of edges of sheet material in the roll, and calculating the length of the roll using the determined number of edges.

Still another provision of the present invention is to provide a method of determining the length of a roll of sheet material as set forth in the preceding paragraph, further including the step of establishing a second signal indicative of the position of the sensed reflected radiation from the side surface of the roll to be measured.

A still further provision of the present invention is to provide an apparatus for determining the number of layers of a plurality of layers of sheet material in a stack of sheet material, including a source of radiation, a scanner for scanning radiation reflected from the edges of the stack of material and establishing a first signal indicative of the radiation reflected from the edges of the stack of sheet material, and a microprocessor for processing the first signal to determine the number and layers of sheet material in the stack of sheet material to be measured.

Another provision of the present invention is to provide a method of determining the number of layers of sheet material in a stack of sheet material, including the steps of exposing a side surface of the stack of sheet material to be measured to a source of radiation, sensing radiation reflected from the side surface of the stack, establishing a first signal indicative of the sensed reflected radiation, processing the first signal to determine the presence of an edge of each of the layers of sheet material in the stack of sheet material, and determining the number of edges of layers of sheet material and calculating the number of edges of sheet material in the stack of sheet material.

DESCRIPTION OF THE PREFERRED EMBODIMENT

Figure 1:
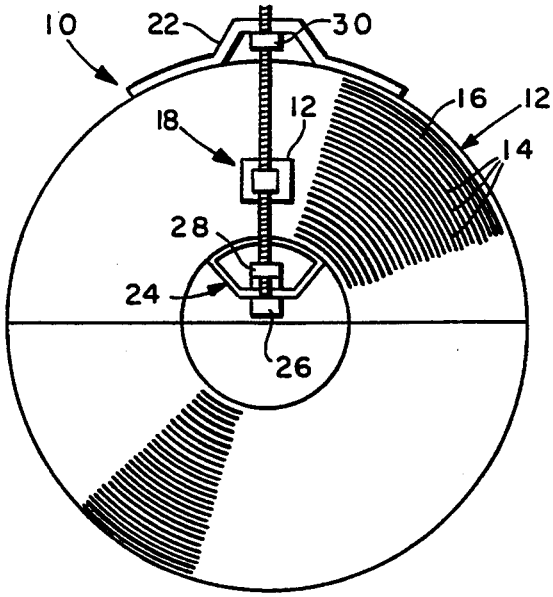
FIG. 1 is a side view of the coil reader mounted on a coil.
Figure 2:
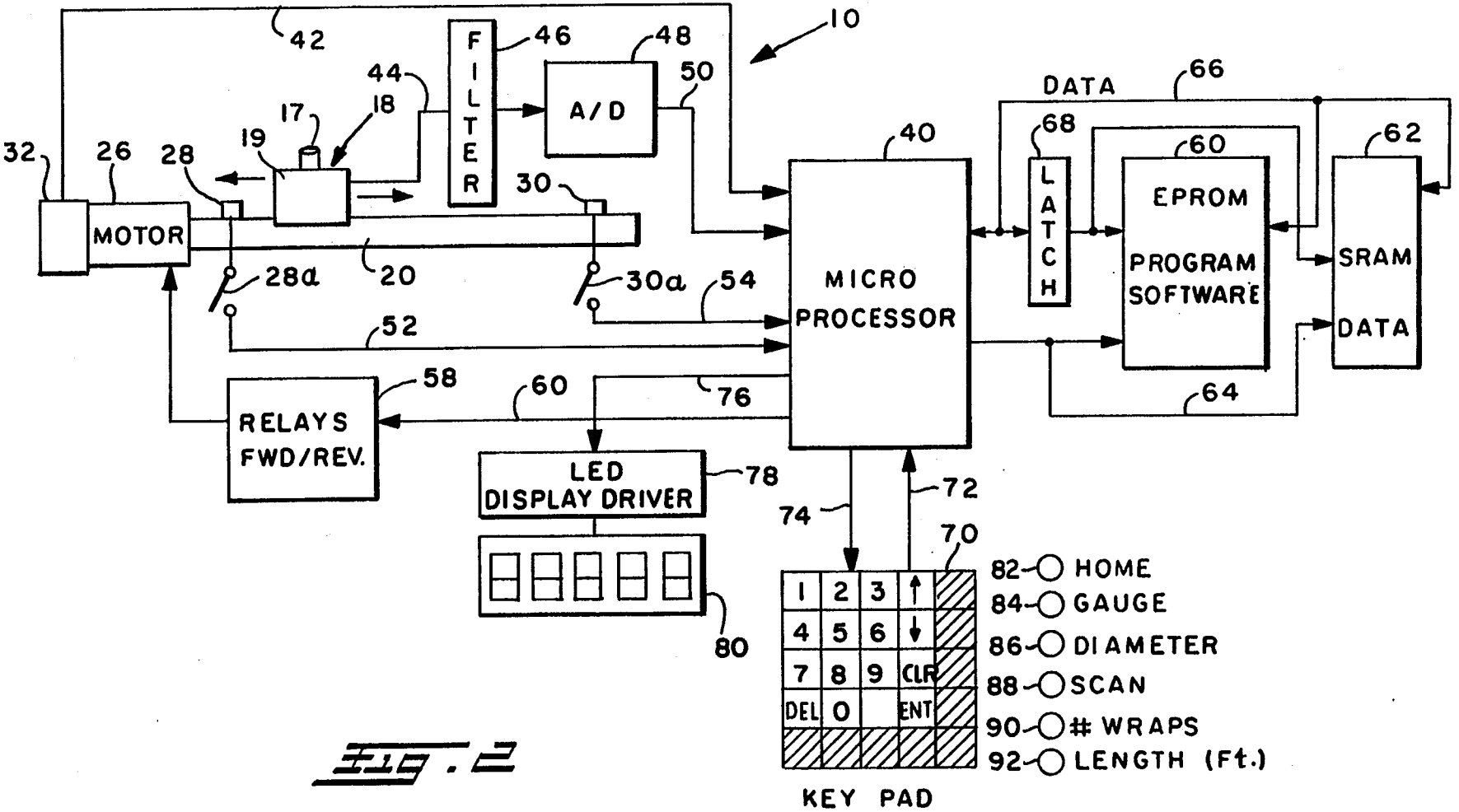
FIG. 2 a schematic illustration of the coil reader and the circuitry associated therewith.

Referring to the figures, and more particularly, to FIGS. 1 and 2, a coil reader 10 is illustrated. The coil reader 10 is adapted to scan the edges 16 of a coil or coiled roll of sheet material 12 and to accurately calculate the length of the roll 12 of sheet material. The roll of sheet material 12 includes a plurality of layers or wraps 14, each of which includes an edge portion 16 which is exposed on the side surface of the roll 12. The coil reader 10 is particularly adapted to calculate the length of a roll of sheet steel given the outer diameter of the roll and the nominal gauge or thickness of the material to be measured. However, the coil reader 10 could be used to measure other types of coiled or stacked sheet material such as aluminum, copper, fabrics, and paper which include an exposed edge surface for each coiled layer of the sheet material which is reflective of radiation.

The coil reader 10 includes a scanner 18 which is mounted on a slide 20 which is radially secured to the roll 12 of material to be measured adjacent to the edges 16 of the material to be scanned. The scanner 18 includes a photodetector or radiation sensitive device 17 which is supported on a carriage 19 which is mounted for movement on slide 20. An outer clamp 22 engages with the outer wrap 14 of the roll 12 and an inner clamp 24 engages with the innermost wrap or layer 14 to positively locate and secure the coil reader 10 adjacent to the side surface of the roll 12. A motor 26 engages with the slide 20 to drive the scanner 18 in a radial direction along the slide 20 between a pair of limit switches 28 and 30. Limit switch 28 is located adjacent to the side 20 inside of and spaced from the innermost wrap 14, and limit switch 30 is located adjacent the slide 20 outside of and spaced apart from the outermost wrap or layer 14. An optical encoder 32 is mounted on the shaft of the motor 26 to provide position information as the scanner 18 is driven along slide 20 upon energization of motor 26.

Figure 3:
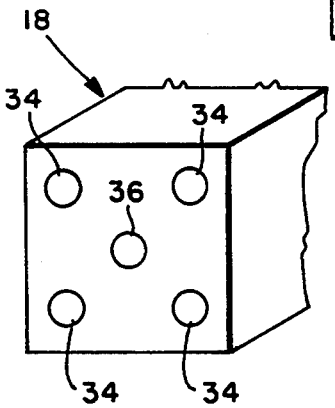
FIG. 3 is a frontal view of an optical bar code scanner which utilized in the coil reader.

In the preferred embodiment of the invention, the scanner 18 is a radiation sensitive detector such as an optical scanner, such as manufactured by Optec Inc, having a head portion as is more fully illustrated in FIG. 3. The optical scanner 18 includes a plurality of LEDs 34 and a detector 36. The LEDs 34 illuminate the edges 16 of the roll 12 as the scanner 18 scans the roll 12 and the detector 36 senses radiation reflected by the edges 16 of the roll 12 and back to the detector 36. The reflected radiation or light detected by detector 36 is processed to determine the number of edges 16 sensed in roll 12. Utilizing the number of edges sensed, the nominal sheet thickness or gauge and the diameter of the roll, the length of the roll 12 can be calculated by the coil reader 10.

Figure 8A:
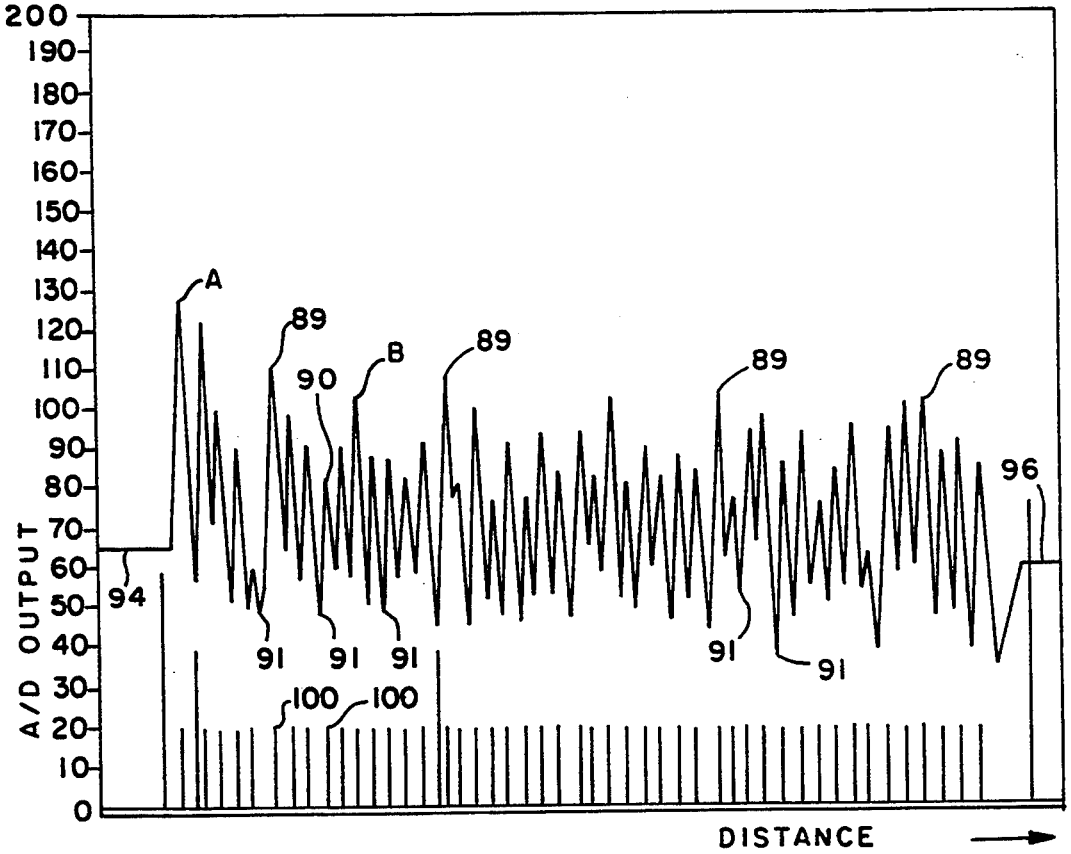
FIG. 8*a* is a graphical illustration of the filtered analog output of the scanner and input to the and the edges sensed by the microprocessor adjacent the analog/digital converter in the top portion of the figure distance axis.

Referring more particularly to FIG. 2, the scanner 18 is driven along slide 20 by motor 26. The optical encoder 32 attached to the motor 26 provides position information on line 42 which is directed to a microprocessor 40. The output of the scanner 18 is directed along line 44 through a low pass filter 46 and to an analog-to-digital converter 48. The filtered analog output of the scanner 18 which is inputed to the A/D converter is illustrated in FIG. 8*a*. The output of the A/D converter is directed along line 50 to microprocessor 40 and provides information on the intensity of the light reflected from the edges 16. Inner limit switch 28, having normally open contacts 28*a*, is operable to close and direct a signal along line 52 to the microprocessor 40 in the event that the motor 26 drives the scanner 18 into engagement with the inner limit switch 28. Outer limit switch 30, having normally open contacts 30*a*, is adapted to establish a signal on line 54 to the microprocessor 40 in the event that the motor 16 drives scanner 18 into limit switch 30. The limit switches 28 and 30 act as safety switches to prevent the motor 26 from driving the scanner too far in either direction. The limit switches are located adjacent slide 20 in positions which enable the scanner to scan all of the edges 16 from the innermost edge 16 to the outermost edge 16. The microprocessor 40 is adapted to establish a control signal on line 56 to control a forward/reverse relay 58 which in turn energizes motor 26 to drive the scanner 18 in the desired direction.

An electrically programmable read-only memory (EPROM) 60 is provided to store the software program for controlling the microprocessor 40 and to process data received from the optical position encoder 32 and the scanner 18. A static random access memory (SRAM) 62 is provided for storing data received from the microprocessor 40 along lines 64 and 66. A latch 68 is utilized to transfer data between the microprocessor 40 and EPROM 60. A keypad 70 is connected via lines 72 and 74 to enter data into the microprocessor 40 and to control the various functions of the coil reader 10. The microprocessor 40 further includes an output 76 connected to an LED display driver 78 which in turn drives a five segment LED display 80. A plurality of indicating lights 82, 84, 86, 88, 90 and 92 indicate the status of the coil reader 10.

When it is desired to scan a coil 12, the coil reader 10 is radially affixed to the coil 12 adjacent to the edges 16 as is illustrated in FIG. 1. The coil reader 10 is then energized and the enter key on keyboard 70 is actuated to energize motor 26 to drive the scanner 18 to its home position, which is defined as adjacent to but located inside of the innermost layer 14 of the roll 12. The display 80 will read READY when the scanner 18 is moved to its home position.

The down arrow on the keyboard 70 is now actuated to cycle the coil reader 10 to its next function. At this time, home indicator 82 is extinguished, gauge indicator 84 lights and the nominal gauge of the sheet metal or thickness of the material to be measured is entered into the keyboard 70. The display 80 initially displays 0.000 until the gauge is entered, at which time the entered gauge will be displayed on the display 80 and stored in the microprocessor 40 for future use.

The down function arrow, or enter key, on the keyboard 70 is again actuated to go to the next function. This extinguishes gauge indicator 84 and lights the diameter indicator 86. At this time, the diameter of the roll of material 12 is measured with a tape to the nearest tenth of an inch. The diameter is then entered into the keypad 70, displayed on the display 80, and stored in the microprocessor 40 for future use. While the diameter has been entered, it should be apparent that the outer radius could also be utilized in place of the diameter. The down arrow on the keyboard 70 is actuated and the diameter indicator 86 is extinguished and the scan indicator 88 now lights. At this time, the microprocessor 40 actuates motor 16 to cause the scanner 18 to scan the edges 16 of the roll 12 from the inside diameter to the outside diameter. The optical position encoder 32 supplies in a second signal position data to the microprocessor 40 and the scanner 18 supplies in a first signal information about the reflected radiation from the edges 16 of the roll 12 to the microprocessor 40. The microprocessor 40 stores the position information and reflected radiation information in the SRAM 62 for future calculations.

After the scan is completed, the microprocessor 40 calculates the DC level of the output of the scanner 18 when no reflection is present. This is the DC output level of the scanner 18 when the scanner is not scanning an edge 16 of the roll 12 but is sensing ambient light. The DC level, when no reflection is present prior to the scanner sensing the inner diameter of the roll, is disclosed at 94 in FIG. 8*a*, and the DC level, when the scanner passes the outer diameter of the roll, is disclosed at 96. The microprocessor 40 uses the DC levels at the inner diameter 94 and outer diameter 96 along with the position information from the optical position encoder 32 to calculate the inner radius and outer radius of the roll 12 of sheet material to be measured.

The input to the A/D converter 48 comprises a wave form, such as illustrated in FIG. 8*a*, which includes a plurality of peaks 89 and troughs 91 which are indicative of the radiation or light reflected from the edges 16 as the roll 12 is scanned by scanner 18. Using a portion of the data stored in the SRAM 62 which is indicative of a portion of the scan of roll 12, for example, one inch of the scan of the roll 12, the microprocessor 40 calculates a minimum peak height based on the nominal gauge width. The minimum peak height is used to analyze the scanned data to locate edges 16 of the roll 12. For example, if the data between point A to point B in FIG. 8*a* were utilized to calculate a minimum peak height based on nominal gauge width, it is possible that the peak 90 would be considered a minimum peak height. The microprocessor 40 then finds all of the peaks 89 and troughs 91 in the data using the minimum peak height. The peaks 89 and troughs 91 are then sequentially paired up to indicate an edge 16 of the material to be measured. Lone peaks are eliminated. An edge 16 will be indicated by a sequential peak and trough which meet predetermined parameters such as minimum peak height and interspacial relationships based on the nominal gauge entered in the coil reader 10. The microprocessor 40 then uses the nominal gauge width and a scaling factor to check inner peak spacing for possible missing peaks. The bars 100 at the bottom of FIG. 8*a* indicate a sensed peak and trough and the location of an edge 16 of the material which has been scanned as determined by the microprocessor 40. The microprocessor measures the distance between the adjacent bars 100 which is indicative of the distance between adjacent edges 16. If the difference is greater than the gauge width times a scaling factor, the program software will instruct the microprocessor to insert a peak or bar 100 for the missing peak. Various scaling factors can be utilized. However, in the preferred embodiment, if the distance between adjacent peaks 100 is greater than 1.5 times the gauge, a peak will be added by the microprocessor 40. Extraneous or extra peaks can also be eliminated in the same manner. For example, if the interpeak spacing between adjacent peaks is less than the entered gauge, the microprocessor can determine that a false or invalid peak has been sensed and eliminate the invalid peak from its calculations. When the calculation is completed, the microprocessor stores the number of peaks and therefore the number of edges 16, wraps or layers 14 in the roll.

After the scan function is complete, the scan indicator 88 is extinguished, the wraps indicator 90 is then energized and the number of wraps or edges 16 determined can now be displayed on display 80. The length of the roll 12 can now be calculated. Utilizing the diameter of the roll 12, the inner and outer radius of the roll, and the number of wraps or edges 16 the microprocessor 40 calculates the length of the roll 12 of sheet material. When the length is calculated, the wrap display 90 will be turned off, the length display 92 will light, and the length will be displayed on the display 80.

The length can be calculated by microprocessor 40 using various formula. The length of the roll can be calculated assuming the length of each wrap is equal to $2(\pi)$ times the average radius where the average radius is found utilizing the inner and outer radius which are added together and divided by two. After the length of the wrap is determined, it is multiplied by the number of wraps to get the length of the roll. Thus:

$D_i$ = spool diameter (inches)
$D_f$ = outside diameter (inches)
$t$ = sheet thickness (inches)
$L$ = length (inches)
$N$ = number of coils $$L = \pi \frac{D_i + D_f}{2} N$$

$$D_f = D_i + (2Nt)$$

$$L = \pi \frac{D_i + D_i + 2Nt}{2} N$$

$$= \pi 2 \frac{D_i + Nt}{2} N$$

$$L = \pi(D_i + Nt)N$$

While the present coil reader 10 has been illustrated as utilizing an optical scanner which senses reflective light, other types of scanners 18 could be utilized which sense both visible radiation such as light and invisible radiation which can be reflected by the edges 16 of the roll 12.

Additionally, the weight of the roll 12 of sheet material could be calculated by the coil reader 10 by inputing the width of the roll 12 (w) and the density of the material (e) in addition to the other known and sensed variables. The weight can be calculated from the following formula:

$$\text{Weight} = \pi w e n t (D_i + N_t).$$

Figure 8B:
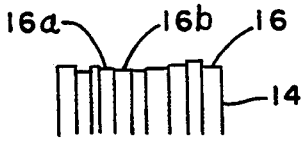
FIG. 8*b* is a fragmentary view schematicly illustrating a plurality of the edges sensed in FIG. 8*a*.

The accuracy of the peaks sensed in the wave form of FIG. 8*a* varies with the quality of the reflected radiation received by the scanner 18 from the edges 16 of the roll 12 of sheet material to be measured. For example, if the edges 16 are of poor quality and non-uniform, it is possible to sense a peak at the initial portion of the scan of edge 16*a*, see FIG. 8*b*, and a subsequent peak at the trailing portion of an adjacent edge 16*b*. This could result in the microprocessor 40 determining that the two adjacent peaks from edges 16*a* and 16*b* are more than one and one-half times the nominal gauge width entered. Using a 1.5 times gauge entered scaling factor, the microprocessor 40 may erroneously insert an edge or peak between the peaks sensed from adjacent edges 16*a* and 16*b*. This is especially true when the thickness of the material varies considerably. In practice, it has been found that the nominal thickness of sheet steel varies between +0.004%. For example, 24 gauge galvanized steel sheets vary between 0.0236 and 0.0316, and 22 gauge galvanized sheet steel varies between 0.0296 and 0.0376.

Figure 4:
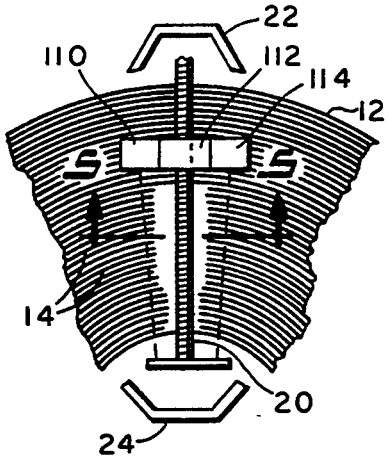
FIG. 4 is a side view of another embodiment of the present invention utilizing a plurality of scanners.
Figure 5:
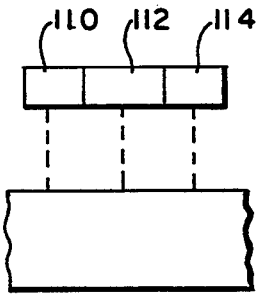
FIG. 5 is a top view of the multiple scanner taken approximately along the lines 5—5 of FIG. 4.
Figure 6:
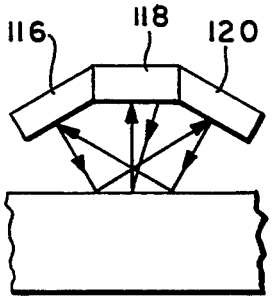
FIG. 6 is a further embodiment of the coil reader s utilizing a plurality of scanner heads.

The embodiments of the invention disclosed in FIGS. 4–6 improve the accuracy of the coil reader 10 by utilizing multiple scanners to provide multiple data streams to the microprocessor 40. This provides increased accuracy by enabling the microprocessor to eliminate skewed data caused by damaged edges, bad reflective surfaces, and other imperfections in the roll 12. The microprocessor can compare the data from each scanner and eliminate non-matching data. In the embodiment disclosed in FIGS. 4 and 5, three scanners 110, 112 and 114 are utilized to scan three parallel radial paths on the edges 16 of roll 12. If desired, the three scanners could be utilized to scan the same radial surface of the edges 16 of roll 12. Other numbers of scanners, such as two, could also be utilized. In addition, instead of using multiple scanners, a single scanner making multiple passes could be utilized to increase the accuracy of the information provided to the microprocessor 40.

In the embodiment illustrated in FIG. 6, three scanners 116, 118 and 120 are illustrated. The scanners 116 and 120 are disposed at an acute angle to the scanner 118. The LEDs, not illustrated, of scanner 116 are directed to reflect to the detector, not illustrated, of scanner 120, and the LEDs of scanner 120 are directed to reflect to the detector, not illustrated, of the scanner 116. The LEDs of scanner 118 are directed to reflect back to the detector of scanner 118. The scanners 116, 118 and 120 could scan different parallel radial paths on the side of roll 12, or could be arranged to simultaneously scan the same radial path on the edges of roll 12. More or less than three scanners could be utilized in the embodiment disclosed in FIG. 6, depending upon the accuracy desired and the characteristics of the material to be scanned. Additionally, while LEDs 34 provide a source of reflected radiation for the scanner to sense, the ambient light could be utilized in some cases.

Figure 7:
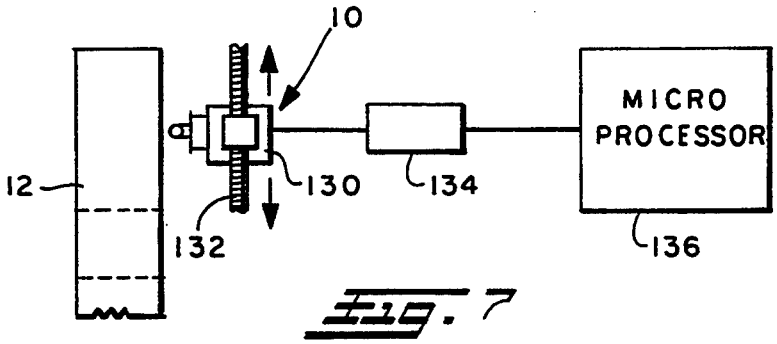
FIG. 7 is another embodiment of the invention which utilizes a video camera to sense the edges of the roll of material to be measured.

The embodiment of the coil reader 10 illustrated in FIG. 7 includes a video camera 130 which takes a picture of the edges 16 of the roll of material 12 to be measured. The video camera 130 may be supported on a slide 132 to position the camera 130 adjacent the side of the roll 12 to be imaged. The camera 130 images the side of the roll and the stored image is electronically scanned and processed to sense the edges 16 of the roll 12 of material in a similar manner as the scanner 18 scans the roll of material 12. The output of the video camera 130 is directed through a digitizer 134 to a microprocessor 136 which processes the data to determine the number of edges 16 present and the length of the material being scanned. A suitable entry device, such as a keypad, and a display device, such as a seven segment display, as is illustrated in FIG. 2, can be utilized with the embodiment disclosed in FIG. 7 to enter and display data. Also, additional memory for the data and program software can also be added, as in FIG. 2, to the embodiment disclosed in FIG. 7.

While the preferred embodiment of the coil reader 10 has been disclosed as calculating the length of a roll of coiled sheet material, the coil reader could also be utilized to sense the number of sheets in a stack of stacked flat sheet material such as sheet steel by scanning the edges of the stack in the same manner as the side of roll 12 is scanned in FIG. 1. The coil reader 10 can then calculate the weight of the stack of sheet material, the number of sheets in the stack, and the square footage of all of the individual sheets in the stack, if the width and length of the stack of sheets is inputed into the coil reader 10.

From the foregoing, it should be apparent that a new and improved apparatus and method has been disclosed for determining the length of a roll 12 of a plurality of layers 14 of coiled sheet material, including a side surface at which the edge 16 of each of the plurality of layers 14 is exposed. The apparatus includes a source of radiation which in the preferred embodiment is the LEDs 34 which are directed to the side surface of a roll 12, a scanner 18 for scanning the radiation reflected from the side surface 16 of the roll and establishing a first signal indicative of the radiation reflected from the side surface, a microprocessor 40 for processing the first signal to determine the presence of an edge 16 of each of the plurality of layers 14 of sheet material, and to determine the inner and outer radius of the roll 12. The microprocessor 40 then determines the length of the roll using the diameter of the roll, the inner and outer radius of the roll, and the sensed number of layers of sheet material in the roll. The apparatus can also be used to calculate the number of layers of sheet material in a stack of sheet material in a similar manner.

What we claim is:

1. An apparatus for determining the length of a roll of a plurality of layers of sheet material including a side surface at which the edge of each of the plurality of layers is exposed comprising a source of radiation directed to the exposed edges on the side surface of the roll to be measured, scanner means for scanning in a radial direction the radiation reflected from the edges of the roll to be measured and establishing a first signal indicative of the radiation reflected from the edges of the roll to be measured, a microprocessor for processing said first signal to determine the presence of an exposed edge of each of the plurality of layers of sheet material in the roll to be measured, said microprocessor determining the number of edges of layers of sheet material to determine the number of layers of sheet material in the roll to be measured and calculating the length of the roll of material to be measured using the diameter of the roll and the sensed number of layers of sheet material in the roll, and wherein the nominal thickness of each of the plurality of layers of sheet material in the roll to be measured is predetermined and further including means for entering into said microprocessor the predetermined nominal thickness of the sheet material, said microprocessor utilizing the predetermined thickness of the sheet material to process said first signal to determine if the sensed edges of the layers of sheet material of the roll are valid edges and eliminating any invalid sensed edges of the roll of sheet material from said first signal.

2. An apparatus for determining the length of a roll of a plurality of layers of sheet material, as defined in claim 1, wherein said microprocessor further utilizes the predetermined nominal thickness of the sheet material to process the first signal to determine if any edges of the roll of sheet material are present which have not been sensed and adding the determined non-sensed edges to said number of edges sensed by said microprocessor of the plurality of layers of sheet material.

3. An apparatus for determining the length of a roll of a plurality of layers of sheet material, as defined in claim 2, further including encoder means for providing position information to said microprocessor, said scanner means being movable in a radial direction to scan the radiation reflected from the edges of the roll to be measured, said encoder means establishing a second signal indicative of the position of said scanner as said scanner scans the edges of the roll to be measured, said second signal being directed to said microprocessor to provide position information to said microprocessor to enable said microprocessor to determine if the sensed edges of the sheet material are valid and to determine if edges of the sheet material are present which have not been sensed.

4. An apparatus for determining the length of a roll of a plurality of layers of sheet material, as defined in claim 3, further including support means for supporting said encoder means and said scanner means in a position adjacent the side surface of a roll to be measured, said support means supporting said scanner for movement in a radial direction parallel to the surface of the roll to sense the radiation reflected by the side surface of the roll, said encoder establishing said second signal which is indicative of the position of said scanner and the position of sensed edges of the roll of sheet material.

5. An apparatus for determining the length of a roll of a plurality of layers of sheet material, as defined in claim 4, further including drive means for moving said scanner means in a radial direction to sense the radiation reflected by the edges of the side surface of the roll to be measured.

6. An apparatus for determining the length of a roll of a plurality of layers of sheet material, as defined in claim 1, further including encoder means for providing position information to said microprocessor, said scanner means being movable in a radial direction to scan the radiation reflected from the edges of the roll to be measured, said encoder means establishing a second signal indicative of the position of the scanner as said scanner scans the edges of the roll to be measured, said second signal being directed to said microprocessor to provide position information to said microprocessor to enable said microprocessor to determine the inner and outer radius of the roll of sheet material.

7. An apparatus for determining the length of a roll of a plurality of layers of sheet material, as defined in claim 1, wherein said scanner means comprises a plurality of scanners, each of which senses radiation reflected from the side surface of the roll to be measured, said plurality of scanners establishing said first signal.

8. An apparatus for determining the length of a roll of a plurality of layers of sheet material, as defined in claim 7, wherein each of said plurality of scanners scans the same radial path along the edges of the roll to be measured.

9. An apparatus for determining the length of a roll of a plurality of layers of sheet material, as defined in claim 7, wherein each of said plurality of scanners scans a different radial path along the edges of the roll to be measured.

10. An apparatus for determining the length of a roll of a plurality of layers of sheet material, as defined in claim 1, wherein said scanner means includes a bar code scanner.

11. An apparatus for determining the length of a roll of a plurality of layers of sheet material, as defined in claim 1, wherein said scanner means includes a video camera.

12. An apparatus for determining the length of a roll of a plurality of layers of sheet material, as defined in claim 1, wherein said scanner means scans the edges of the roll to be measured a plurality of times to establish said first signal.

13. An apparatus for determining the length of a roll of a plurality of layers of sheet material including a side surface at which the edge of each of the plurality of layers is exposed comprising a source of radiation directed to the exposed edges on the side surface of the roll to be measured, scanner means for scanning in a radial direction the radiation reflected from the edges of the roll to be measured and establishing a first signal indicative of the radiation reflected from the edges of the roll to be measured, a microprocessor for processing said first signal to determine the presence of an exposed edge of each of the plurality of layers of sheet material in the roll to be measured, said microprocessor determining the number of edges of layers of sheet material to determine the number of layers of sheet material in the roll to be measured and calculating the length of the roll of material to be measured using the diameter of the roll and the sensed number of layers of sheet material in the roll, and wherein the nominal thickness of each of the layers of the roll of sheet material is predetermined and further including means for entering into said microprocessor the predetermined nominal thickness of the sheet material, said microprocessor utilizing the predetermined nominal thickness of the sheet material to process said first signal to determine if any edges of the roll of sheet material are present which have not been sensed, and adding the determined non-sensed edges to the number of edges sensed by said microprocessor of the plurality of layers of sheet material.

14. A method of determining the length of a roll of a plurality of layers of sheet material, including a side surface at which the edge of each of the plurality of layers is exposed, including the steps of:

exposing the side surface of the roll to be measured to a source of radiation;

sensing the radiation reflected from the side surface of the roll;

establishing a first signal indicative of the sensed reflected radiation from the side surface of the roll;

processing the first signal to determine the presence of an edge of each of the layers of sheet material in the roll to be measured and determining the number of edges of layers of sheet material in the roll;

calculating the length of the roll using the determined number of edges of layers of sheet material in the roll, and wherein the nominal thickness of the sheet material is predetermined, and further including the steps of:

establishing a predetermined nominal thickness of the sheet material to be measured;

using said selected predetermined nominal thickness to determine if the sensed edges of layers of sheet material in the processed first signal are valid edges; and eliminating any invalid sensed edges from said first signal.

15. A method of determining the length of a roll of a plurality of layers of sheet material, as defined in claim 14, further including the step of measuring the diameter of the roll and wherein said step of calculating includes the step of calculating the length of the roll using the measured diameter and the determined number of edges of layers of sheet material in the roll

16. A method of determining the length of a roll of a plurality of layers of sheet material, as defined in claim 14, further including the step of using said established predetermined nominal thickness of the sheet material to determine if any edges of the roll of sheet material are present which have not been sensed in the processed first signal and adding the determined non-sensed edges to the processed first signal.

17. A method of determining the length of a roll of a plurality of layers of sheet material, as defined in claim 16, further including the step of establishing a second signal indicative of the position of the sensed reflected radiation from the edges of the side surface of the roll to be measured.

18. A method of determining the length of a roll of a plurality of layers of sheet material, as defined in claim 14, further including the step of establishing a second signal indicative of the position of the sensed reflected radiation from the edges of the side surface of the roll to be measured.

19. A method of determining the length of a roll of a plurality of layers of sheet material, as defined in claim 14, wherein said step of sensing the radiation reflected from the side of the roll includes the step of scanning, in a radial direction, the side surface of a roll of material to be measured between the inner radius and outer radius of the roll to establish said first signal.

20. A method of determining the length of a roll of a plurality of layers of sheet material, as defined in claim 19, wherein said step of establishing a second signal indicative of the position of the sensed reflected radiation includes the step of encoding the scanning, in a radial direction, of the side surface of the roll of material to be measured to establish said second signal which is indicative of the position of the sensed reflected radiation as indicated by said first signal.

21. A method of determining the length of a roll of a plurality of layers of sheet material, as defined in claim 19, wherein said step of scanning in a radial direction the side surface of the roll to be measured includes the step of scanning a plurality of times the same radial path along the side surface of the roll to establish said first signal.

22. A method of determining the length of a roll of a plurality of layers of sheet material, as defined in claim 19, wherein said step of scanning in a radial direction the side surface of the roll to be measured includes the step of scanning a plurality of radial paths along the side surface of the roll to establish said first signal.

23. A method of determining the length of a roll of a plurality of layers of sheet material, as defined in claim 19, wherein said step of scanning in a radial direction the side surface of the roll to be measured includes the step of scanning the side surface with an optical scanner.

24. A method of determining the length of a roll of a plurality of layers of sheet material, as defined in claim 14, wherein said step of sensing the radiation reflected from the side surface of the roll to be measured includes sensing said radiation with a video camera.

25. A method of determining the length of a roll of a plurality of layers of sheet material, including a side surface at which the edge of each of the plurality of layers is exposed, including the steps of:

exposing the side surface of the roll to be measured to a source of radiation;

sensing the radiation reflected from the side surface of the roll;

establishing a first signal indicative of the sensed reflected radiation from the side surface of the roll;

processing the first signal to determine the presence of an edge of each of the layers of sheet material in the roll to be measured and determining the number of edges of layers of sheet material in the roll;

calculating the length of the roll using the determined number of edges of layers of sheet material in the roll, and wherein the nominal thickness of the sheet material is predetermined, and further including the steps of:

establishing a predetermined nominal thickness of the sheet material to be measured;

using said selected predetermined nominal thickness to determine if any edges of the roll of sheet material are present which have not been sensed in the processed first signal; and adding the determined non-sensed edges to the processed first signal.

26. An apparatus for determining the number of a plurality of layers of sheet material including a side surface at which the edge of each of the plurality of layers is exposed comprising a source of radiation directed to the exposed edges on the side surface of the plurality of layers of sheet material to be measured, scanner means for scanning the radiation reflected from the edges of the plurality of layers of sheet material to be measured and establishing a first signal indicative of the radiation reflected from the edges of the sheet material to be measured, a microprocessor for processing said first signal to determine the presence of an exposed edge of each of the plurality of layers of sheet material to be measured, said microprocessor determining the number of edges of layers of sheet material to determine the number of layers of sheet material in the plurality of layers of sheet material to be measured, and wherein the nominal thickness of each of the layers of sheet material to be measured is predetermined and further including means for entering into said microprocessor the predetermined nominal thickness of the sheet material, said microprocessor utilizing the predetermined nominal thickness of the sheet material to process said first signal to determine if the sensed edges of the layers of sheet material in the plurality of layers of sheet material to be measured are valid edges and eliminating any invalid sensed edges of the sheet material from said first signal.

27. An apparatus for determining the number of a roll of a plurality of layers of sheet material, as defined in claim 26, wherein said microprocessor further utilizes the predetermined nominal thickness of the sheet material to process the first signal to determine if any edges of sheet material are present which have not been sensed and adding the determined non-sensed edges to said number of edges sensed by said microprocessor of the plurality of layers of sheet material.

28. An apparatus for determining the number of a plurality of layers of sheet material, as defined in claim 26, further including encoder means for providing position information to said microprocessor, said scanner means being movable to scan the radiation reflected from the edges of the plurality of layers of sheet material to be measured, said encoder means establishing a second signal indicative of the position of the scanner as said scanner scans the edges of the sheet material to be measured, said second signal being directed to said microprocessor to provide position information to said microprocessor.

29. An apparatus for determining the number of a plurality of layers of sheet material, as defined in claim 26, wherein said scanner means comprises a plurality of scanners, each of which senses radiation reflected from the side surface of the sheet material to be measured, said plurality of scanners establishing said first signal.

30. An apparatus for determining the number of a plurality of layers of sheet material, as defined in claim 29, wherein each of said plurality of scanners scans the same path along the edges of the sheet material to be measured.

31. An apparatus for determining the number of a plurality of layers of sheet material, as defined in claim 29, wherein each of said plurality of scanners scans a different path along the edges of the sheet material to be measured.

32. An apparatus for determining the number of a plurality of layers of sheet material, as defined in claim 26, wherein said scanner means scans the edges of the sheet material to be measured a plurality of times to establish said first signal.

33. An apparatus for determining the number of plurality of layers of sheet material, as defined in claim 26, wherein said plurality of layers of sheet material are arranged in a roll of a plurality of layers of sheet material and the number of determined edges of layers of sheet material is utilized to calculate the length of the roll of sheet material.

34. An apparatus for determining the number of plurality of layers of sheet material, as defined in claim 26, wherein said plurality of layers of sheet material are arranged in a stack of flat sheet material and the number of determined edges of layers of sheet material is used to calculate the square footage of the stack of flat sheet material.

35. An apparatus for determining the number of a plurality of layers of sheet material including a side surface at which the edge of each of the plurality of layers is exposed comprising a source of radiation directed to the exposed edges on the side surface of the plurality of layers of sheet material to be measured, scanner means for scanning the radiation reflected from the edges of the plurality of layers of sheet material to be measured and establishing a first signal indicative of the radiation reflected from the edges of the sheet material to be measured, a microprocessor for processing said first signal to determine the presence of an exposed edge of each of the plurality of layers of sheet material to be measured, said microprocessor determining the number of edges of layers of sheet material to determine the number of layers of sheet material in the plurality of layers of sheet material to be measured, and wherein the nominal thickness of each of the layers of sheet material is predetermined and further including means for entering into said microprocessor the predetermined nominal thickness of the sheet material, said microprocessor utilizing the predetermined nominal thickness of the sheet material to process said first signal to determine if any edges of the sheet material are present which have not been sensed, and adding the determined non-sensed edges to number of edges sensed by said microprocessor of the plurality of layers of sheet material.

36. A method for determining the number of a plurality of layers of sheet material, including a side surface at which the edge of each of the plurality of layers is exposed, including the steps of:

exposing the side surface of the plurality of layers of sheet material to be measured to a source of radiation;

sensing the radiation reflected from the side surface of the sheet material;

establishing a first signal indicative of the sensed reflected radiation from the side surface of the sheet material;

processing the first signal to determine the presence of an edge of each of the layers of sheet material to be measured and determining the number of edges of layers of sheet material;

and wherein the nominal thickness of the sheet material is predetermined, and further including the steps of:

establishing a predetermined nominal thickness of the sheet material to be measured;

using said selected predetermined nominal thickness to determine if the sensed edges of layers of sheet material in the processed first signal are valid edges;

eliminating any invalid sensed edges from said first signal; and calculating the number of layers of sheet material.

37. A method of determining the number of a plurality of layers of sheet material, as defined in claim 36, further including the step of establishing a second signal indicative of the position of the sensed reflected radiation from the edges of the side surface of the plurality of layers of sheet material to be measured.

38. A method of determining the number of a plurality of layers of sheet material, as defined in claim 34, wherein said step of sensing the radiation reflected from the side of the sheet material includes the step of scanning the side surface of the plurality of layers of material to be measured to establish said first signal.

39. A method of determining the number of a plurality of layers of sheet material, as defined in claim 38, wherein said step of scanning the side surface of the plurality of layers of sheet material to be measured includes the step of scanning a plurality of times the same path along the side surface of the sheet material to establish said first signal.

40. A method of determining the number of a plurality of layers of sheet material, as defined in claim 38, wherein said step of scanning the side surface of the sheet material to be measured includes the step of scanning a plurality of paths along the side surface of the sheet material to establish said first signal.

41. A method for determining the number of a plurality of layers of sheet material, as defined in claim 36, wherein said plurality of layers of sheet material are arranged in a roll of a plurality of layers of sheet material and further including the step of calculating the length of the roll of sheet material using the determined number or edges of layers of sheet material.

42. A method for determining the number of plurality of layers of sheet material, as defined in claim 36, wherein said plurality of layers of sheet material are arranged in a stack of flat sheet material and further including the step of calculating the square footage of the stack of sheet material using the determined number of edges of layers of sheet material.

43. A method for determining the number of a plurality of layers of sheet material, including a side surface at which the edge of each of the plurality of layers is exposed, including the steps of:

exposing the side surface of the plurality of layers of sheet material to be measured to a source of radiation;

sensing the radiation reflected from the side surface of the sheet material;

establishing a first signal indicative of the sensed reflected radiation from the side surface of the sheet material;

processing the first signal to determine the presence of an edge of each of the layers of sheet material to be measured and determining the number of edges of layers of sheet material;

and wherein the nominal thickness of the sheet material is predetermined, and further including the steps of:

establishing a predetermined nominal thickness of the sheet material to be measured;

using said selected predetermined nominal thickness to determine if any edges of the sheet material are present which have not been sensed in the processed first signal;

adding the determined non-sensed edges to the processed first signal; and calculating the number of layers of sheet material.

* * * * *